US006196040B1

(12) United States Patent
Matsuoka

(10) Patent No.: US 6,196,040 B1
(45) Date of Patent: Mar. 6, 2001

(54) NEGATIVE ANGULAR FORMING DIE AND PRESSING APPARATUS

(75) Inventor: Mitsuo Matsuoka, Osaka (JP)

(73) Assignee: Umix Co., Ltd., Osaka (JP)

( * ) Notice: Subject to any disclaimer, the term of this patent is extended or adjusted under 35 U.S.C. 154(b) by 0 days.

(21) Appl. No.: 09/442,503

(22) Filed: Nov. 18, 1999

(30) Foreign Application Priority Data

Apr. 15, 1999 (JP) ..... 11-107742

(51) Int. Cl.[7] ..... B21D 5/04
(52) U.S. Cl. ..... 72/315; 72/387; 72/452.9
(58) Field of Search ..... 72/315, 314, 313, 72/312, 452.9, 387

(56) References Cited

U.S. PATENT DOCUMENTS 5,784,916 * 7/1998 Matsuoka ..... 72/313
6,038,908 * 3/2000 Kinoshita ..... 72/315

FOREIGN PATENT DOCUMENTS 59-197318 * 11/1984 (JP) ..... 72/313
4-167938 * 6/1992 (JP) ..... 72/312
5-38534 * 2/1993 (JP) ..... 72/312

* cited by examiner

*Primary Examiner*—Daniel C. Crane
(74) *Attorney, Agent, or Firm*—Birch, Stewart, Kolasch & Birch, LLP

(57) ABSTRACT

A negative angular forming die having a lower die for supporting a workpiece. An upper die is lowered with respect to the lower die to abut against the workpiece for forming the workpiece. A columnar body is rotatably mounted on the lower die, and a groove is formed in the columnar body in the axial direction of the lower die. A slide cam is supported on the upper die and is opposed to the columnar body. An automatic returning tool is provided on the lower die for rotating and retracting the columnar body to a position at which the workpiece can be taken out from the lower die after the forming process is completed. The workpiece is placed on the supporting portion of the lower die with the columnar body being turned, and the slide cam is slid to form the workpiece by an entering forming portion of the columnar body. The columnar body is turned and retracted by the automatic returning tool after forming so that the formed workpiece can be taken out from the lower die. A clamping member is slidably mounted in the columnar body and acts to clamp the workpiece during forming.

15 Claims, 13 Drawing Sheets

NEGATIVE ANGULAR FORMING DIE AND PRESSING APPARATUS

BACKGROUND OF THE INVENTION

1. Field of the Invention

The present invention relates to negative angular forming dies for forming a thin metal plate and a pressing apparatus thereof. The term "negative angular forming dies" means forming dies whose upper die enters into its lower die from the lowering locus. The negative angular forming process in which a thin metal plate workpiece enters into the lower die from the lowering locus is generally carried out using a slide cam.

2. Description of the Background Art

In a conventional entering forming of a thin metal plate workpiece, the workpiece is placed on a lower die, an upper die is vertically lowered, and a follower cam of the lower die is driven by an operation cam of the upper die. The workpiece is worked from the lateral direction, and when the working is completed and the upper die rises, the operation cam is retracted by a spring.

In this operation, a forming portion of the follower cam which slides from the outer and lateral direction of the workpiece to form the workpiece is integrally formed into the same shape as that of a forming portion of the workpiece. However, since the forming portion of the lower die on which the workpiece is placed must be taken out from the lower die after the working is completed, the entering portion of the lower die must be divided and retracted, or a rear portion of the entering portion must be cut out so that the workpiece can be moved forward and the workpiece can be taken out. When the entering degree is small, there are no serious difficulties. However, when the entering degree is large, or when the workpiece is a part such as a thin metal plate front pillar outer of an automobile, having a long narrow frame-like cross section and having a groove shape, problems may occur. Since the groove width of the workpiece is narrow, if a portion of the entering lower die is divided or cut out, the shape of the workpiece is not clearly formed by the forming portion of the follower cam. Further, the strength of the lower die is insufficient, and it is difficult to carry out the entering forming.

Further, in the case of the entering forming by the slide cam, since the follower cam is allowed to slide for a long distance, it is not always easy to repeatedly slide the follower cam accurately at the specified position, and it is difficult to produce products of consistent quality.

Further, twisting or distortion occurs in the product and an adjustment of the product is sometimes required. However, in the case of a part having a three-dimensional curved surface, as in an outer plate portion of an automobile such as a side panel, a fender, a root a bonnet, a trunk lid, a door panel, or a front pillar outer, it is almost impossible to fix or adjust the product. In the case of assembling thin metal plates of the automobile, if twist or distortion occurs in the product, it is difficult to join the product to another part. It is also difficult to provide a thin metal plate structure of high quality, and to maintain a predetermined precision of the product of the thin metal plate molding.

If a slide cam is used, it is necessary to provide a large follower cam or heel on a side on which the workpiece of the lower die is placed. Therefore, the area of the lower die is increased, and the weight and the cost of the pressing dies are increased correspondingly.

To solve the above problems, a structure is proposed in which the lowering straight motion of the upper die is converted into rotational motion to rotate a columnar body, thereby forming a forming portion which enters into the lower die from the lowering locus in the straight direction of the upper die. The columnar body is subsequently rotated and retracted to a state in which the formed workpiece can be taken out from the lower die.

This configuration is shown in FIGS. 11 to 14. The negative angular forming dies include a lower die 102 having a supporting portion 101 on which a thin metal plate workpiece W is placed. An upper die 103 is lowered straight with respect to the lower die 102, and abuts against the workpiece W, forming the workpiece W. A groove 104 is opened at an outer peripheral surface in the axial direction, and an entering forming portion 107 enters from the locus of the upper die 103 and is formed on an edge of the groove 104 near the supporting portion 101. The lower die 102 is provided with a rotatable columnar body 106 and an entering forming portion 105. The upper die 103 is slidably provided with a slide cam 108 which is opposed to the columnar body 106, and the lower die 102 is provided with an automatic return tool 109 for rotating and retracting the columnar body 105 to a state in which the workpiece W can be taken out from the lower die 102 after the forming. The workpiece W is placed on the supporting portion 101 of the lower die 102, and along with the entering forming portion 105 of the columnar body 106 and the entering forming portion 107 of the slide cam 108, the columnar body 106 is rotated, and the slide cam 108 slides, thereby forming the workpiece W. After the forming, the columnar body 106 is rotated and retracted by the automatic return tool 109 so that the formed workpiece W can be taken out from the lower die 102.

The operation of this negative angular forming die will be described below.

First, as shown in FIG. 11, the upper die 103 is located at top dead center. At that time, the workpiece W is placed on the supporting portion 101 of the lower die 102, and the columnar body 106 is rotated and retracted by the automatic returning tool 109.

Next, the upper die 103 starts lowering, as shown in FIG. 12, and, a pad 110 first pushes the workpiece W against the supporting portion 101. Then, a lower surface of the slide cam 108 abuts against a rotation plate 111 such that the slide cam 108 does not interfere with the entering forming portion 105 of the columnar body 106, thereby rotating the columnar body 106 rightward as shown in FIG. 12.

When the upper die 103 continues lowering, the slide cam 108 (which is biased outwardly from the upper die) is moved leftward in the lateral direction by the operation of the cam against the biasing force of a coil spring 112, to assume a state shown in FIG. 13. The entering forming of the workpiece W is carried out by the entering forming portion 105 of the rotated columnar body 106 and the entering forming portion 107 of the slide cam 108.

After the entering forming, the upper die 103 starts rising. The slide cam 108 is biased outward from the die by the coil spring 112, and the slide cam 108 is moved rightward in FIG. 14 and rises without interfering with the entering formed workpiece W.

Because the slide cam 108 (which restricts the columnar body 106) rises, the columnar body 106 is rotated counterclockwise by the automatic returning tool 109 as viewed in FIG. 14. When the entering formed workpiece W is taken out from the lower die 102, the workpiece W can be taken out without interfering with the entering forming portion 105 of the columnar body 106.

Even when the workpiece is changed straightly in the axial direction (a perpendicular direction with respect to the paper surface of FIG. 11) or is changed curvilinearly, if the amount of change is small (i.e., the radius of curvature is great), a wrinkle is typically not generated in the entering forming portion of the workpiece.

However, when the workpiece is changed curvilinearly in the axial direction and the amount of change is great (i.e., the radius of curvature is small), a wrinkle is generated in the entering forming portion of the workpiece.

FIG. 12 shows a state before the entering forming. As can be seen from FIG. 12, the entering forming portion 107 of the slide cam 108 merely pushes the workpiece W without pressing and clamping the workpiece W, thereby generating a wrinkle between the entering forming portion 105 of the columnar body 106 (when the workpiece is largely changed curvilinearly in the axial direction).

Although it may be effective to incorporate various mechanism into the rotating element for preventing the wrinkle from being generated, since the rotating element is extremely small, it is difficult to incorporate the various mechanisms.

A wrinkle is generated in the entering forming portion in the case of a so-called shrink flange forming in which a formed portion shrinks after forming, but the case of a so-called extending flange forming in which the formed portion extends after forming, the wrinkle is not generated.

SUMMARY OF THE INVENTION

The present invention is in part addressed to the prevention of a wrinkle being generated in the entering portion of a workpiece by pressing and clamping the entering portion of the workpiece. The invention includes negative angular forming dies, in which a lower die has a supporting portion on which a thin metal plate workpiece is placed, and an upper die which is lowered in the straight direction with respect to the lower die to abut against the workpiece for forming the workpiece. A groove is formed in the axial direction so as to open at an outer peripheral surface, and an entering forming portion formed on an edge of the groove is closer to the supporting portion such as to enter from the locus of the upper die. A columnar body is rotatably mounted on the lower die.

A slide cam is slidably provided on the upper die so as to be opposed to the columnar body, and an automatic returning tool is provided on the lower die for rotating the columnar body to a state where the workpiece can be taken out from the lower die after the forming. The workpiece is placed on the supporting portion of the lower die, and the columnar body is turned and the slide cam slided to form the workpiece by the entering forming portion of the columnar body, and the entering forming portion of the slide cam. The columnar body is turned and retracted by the automatic returning tool after forming so that the formed workpiece can be taken out from the lower die, wherein a clamping member of a negative angular forming portion of the workpiece is slidably provided on the columnar body. The workpiece is clamped by the pressed clamping member and the slide cam and formed.

Further, according to the present invention, in negative angular forming in which a lowering locus of an upper die enters into a lower die, in order to prevent a wrinkle from being created in the entering portion of a workpiece by pressing and clamping the entering portion of the workpiece, a pressing apparatus is provided. The pressing apparatus includes a lower die having a supporting portion on which a thin metal plate workpiece is placed, and an upper die which is lowered in the straight direction with respect to the lower die to abut against the workpiece for forming the workpiece. A groove is formed in the axial direction so as to open at an outer peripheral surface, and an entering forming portion is formed on an edge of the groove closer to the supporting portion so as to enter from the locus of the upper die. A columnar body is rotatably mounted on the lower die.

A slide cam is slidably mounted on the upper die so as to be opposed to the columnar body, and an automatic returning tool is provided on the lower die for rotating and retracting the columnar body to a state where the workpiece can be taken out from the lower die after the forming. The workpiece is placed on the supporting portion of the lower die, the columnar body is turned, and the slide cam is slided to form the workpiece by the entering forming portion of the columnar body and the entering forming portion of the slide cam. The columnar body is turned and retracted by the automatic returning tool after forming so that the formed workpiece can be taken out from the lower die.

The pressing apparatus also includes a workpiece pressing and clamping member for pressing and clamping the workpiece by the slide cam. The workpiece pressing and clamping member also has an entering forming portion slidably provided on the columnar body, and a transmit member projected from the workpiece pressing and clamping member for transmitting pressure. A pressure apparatus is provided for transmitting pressure to the transmit member, and moving means moves the pressure apparatus as the upper die is lowered. A lock means locks the movement of the transmit member.

Further, in the pressing apparatus, the pressure apparatus may be a gas spring. The lock means is a holding piece which engages the groove of the transmit member, and a resilient element is interposed between the workpiece pressing and clamping member and the columnar body in order to draw the workpiece pressing and clamping member and the transmit member toward the workpiece.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

The present invention will be explained below in detail based on the embodiment shown in the accompanying drawings.

Figure 1A:
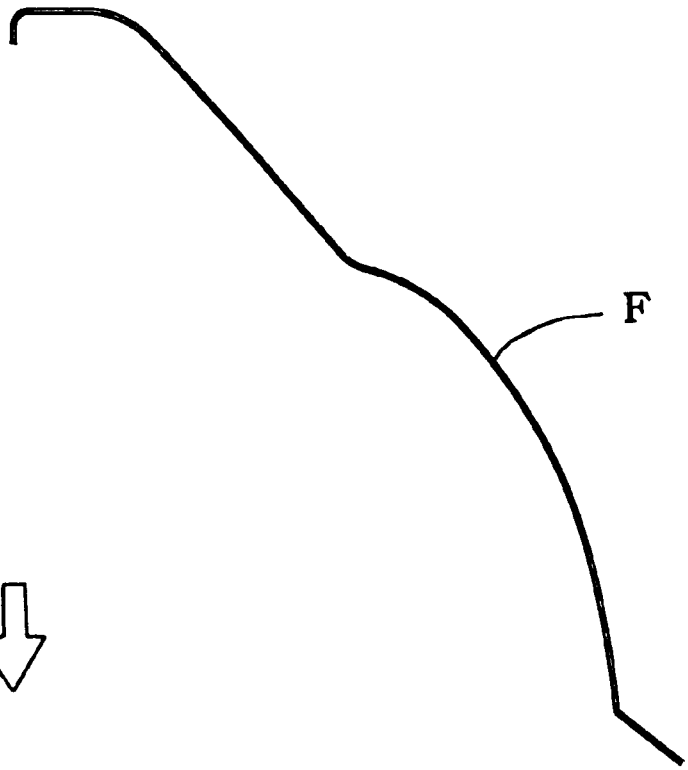
FIGS. 1*a* and 1*b* are cross-sectional views respectively showing a fender, which is a thin metal plate part of an automobile, before and after being formed by negative angular forming dies of the present invention.
Figure 1B:
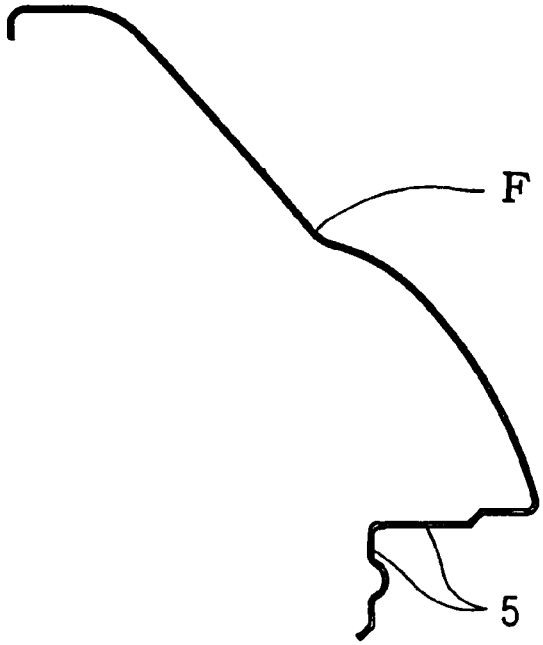

FIGS. 1*a* and 1*b* are cross-sectional views showing a fender F before and after being formed by negative angular forming dies of the present invention. A lower portion of the fender F is an entering forming portion 5. The entering forming portion 5 of the fender F varies largely curvilinearly in its axial direction. The working process is referred to as shrink flange forming in which the formed portion shrinks after forming. The fender has a three-dimensional curved surface for constituting an outer plate portion of an automobile.

Figure 2:
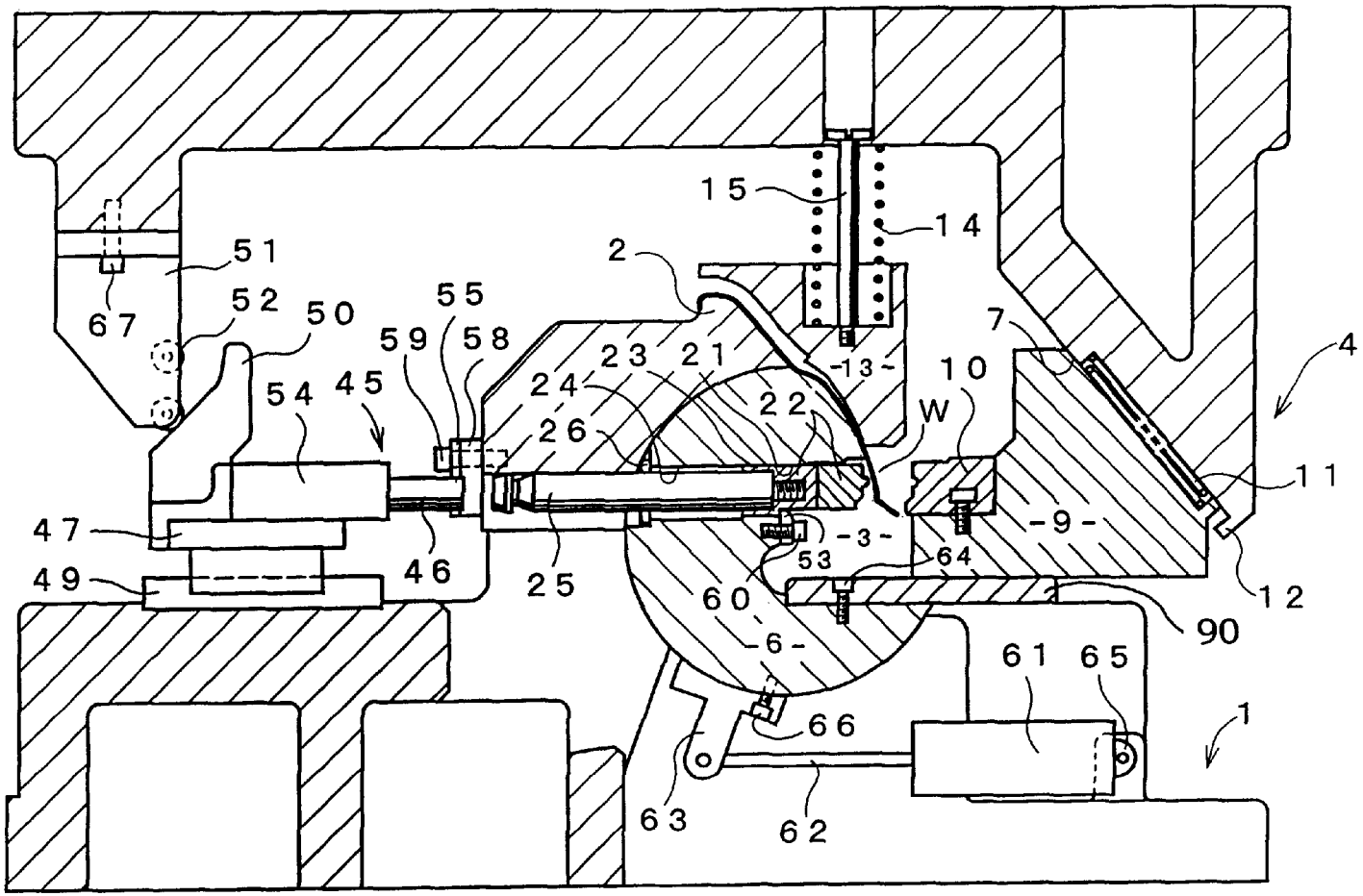
FIG. 2 is a vertical cross-sectional view of a state in which an upper die of the negative angular forming dies of the present invention for entering forming the fender shown in FIGS. 1*a* and 1*b* is lowered from top dead center and a pressing apparatus starts advancing.

In FIG. 2, a lower die 1 is formed at its upper portion with a supporting portion 2 for a workpiece W, and is provided with a groove 3 which is opened at its outer peripheral surface and formed in the axial direction. The lower die 1 is rotatably provided with a columnar body 6 formed with an entering forming portion which enters from the locus of an upper die 4 on an edge at the side of the supporting portion 2 of the groove 3. The lower die 1 is provided with an air cylinder 61 as an automatic returning tool for rotating and retreating the columnar body 6 so that the workpiece W can be taken out from the lower die 1 after the workpiece W is formed.

The air cylinder 61 is connected to the lower die 1 through a pin 65. A tip end of the piston rod 62 is connected, through a pin, to a link 63 fixed to an outer periphery of the columnar body 6 through a bolt 66. As the automatic returning tool, a push pin biasing outward of an air pressure apparatus by a coil spring, a hydraulic apparatus, a link mechanism, a cam or a similar mechanism can be used.

The upper die 4 is provided with a slide cam 9 which slides to a position opposed to the columnar body 6. The slide cam 9 is formed at an upper portion of its tip end with an entering forming portion 10. The slide cam 9 is guided by a guide (not shown), and the slide cam 9 is biased outwardly of the dies by a coil spring 11 compressed between an upper surface of the slide cam 9 and an inclined guide portion 7. The slide cam 9 is stopped by a stopping portion 12 extending from the inclined guide portion 7.

A pad 13 is biased downwardly by a coil spring 14 and is hung from the upper die 4 by a hanger bolt 15. The workpiece W is strongly pushed so that the workpiece W does not move before the entering forming step is performed.

In order to make it possible to press and clamp a portion of the workpiece W which becomes the entering portion between the entering forming portion 10 of the slide cam 9 so that a wrinkle is not generated in the entering portion of the workpiece W, the dies comprise a work pressing and clamping member for pressing and clamping the workpiece between the workpiece pressing and clamping member and the slide cam and having an entering forming portion slidably provided on the columnar body, a transmit member projected from the workpiece pressing and clamping member for transmitting the pressure, a pressing apparatus for transmitting the pressure to the transmit member, moving means for moving the pressure apparatus with the lowering movement of the upper die, and lock means for moving the pressure apparatus with the lowering movement of the upper die, and lock means for locking the movement of the transmit member.

The workpiece W is pressed and clamped between the entering forming portion 10 of the slide cam 9 and pads 22. The pads 22 are slidably provided in a guide hole 21 of the columnar body 6. In order to clearly form the shape of the workpiece W at the bottom dead center, left end surfaces of the pads 22 as viewed in the drawing are formed such that the left end surfaces can collide against a bottom surface 23 of the guide hole 21. A left side of the guide hole 21 is continuously formed with through holes 24 whose diameter is slightly larger than that of the guide hole 21.

Round bar-like transmit bars 25 are threadedly connected to the left end portions of the pads 22, and the transmit bars 25 are passed through the through holes 24 and extended outward. Guide plates 26 are fixed to the ends of the through holes 24 of the columnar body 6 for guiding the transmit bars 25. Each of the transmit bars 25 is turned together with the columnar body 6 which turns by driving of the air cylinder 61.

Figure 3:
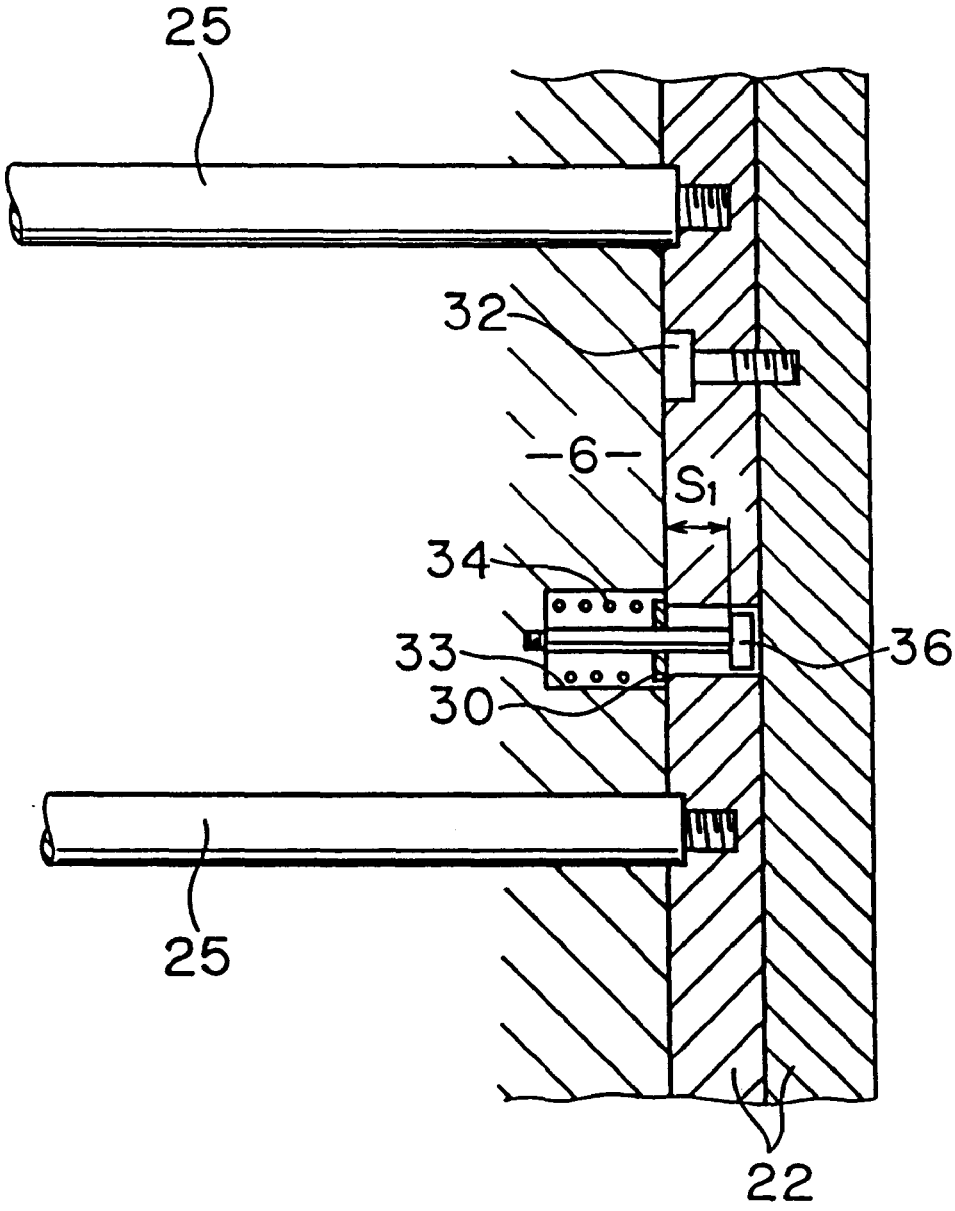
FIG. 3 is a plan view of transmit bars, a pad and a coil spring for biasing the pad.
Figure 4:
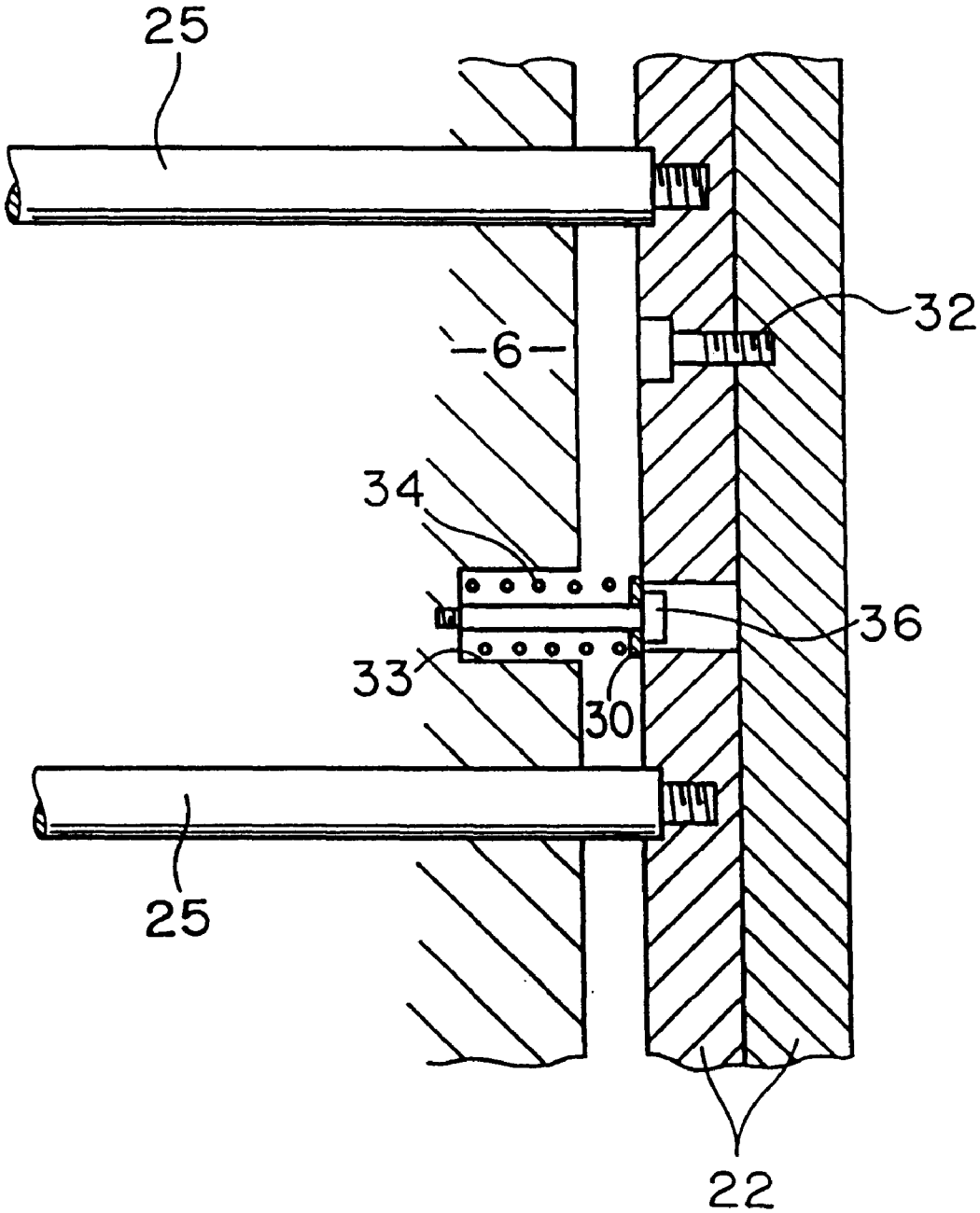
FIG. 4 is a plan view of a state in which the coil spring is extended.

FIG. 3 is a plan view of the transmit bars 25, the pad 22 and the coil spring 34 for biasing the pad 22 as viewed from the above. The transmit bars 25 are disposed at an appropriate distance from each other at position suitable for pressing the pads 22. The pads 22 comprise two long members fixed to each other by a bolt 32. The pads 22 may be a single member. The coil spring 34 is mounted in a holding hole 33 formed in the columnar body 6. The coil spring 34 is abutted against a washer 30. A supporting bolt 36 is passed through the washer 30 and the coil spring 34 and threaded into the bottom of the holding hole 33. S1 shown in FIG. 3 is a stroke of pad 22 based on the coil spring 34. After the workpiece W is formed at the bottom dead center, the coil spring 34 functions as a knockout that ejects the formed workpiece W from the formed position. After the forming is completed, the columnar body 6 is turned and retracted by the air cylinder 61. Then, when a new workpiece is formed, the columnar body 6 is again turned by the air cylinder 61, and functions to position the tip ends of the transmit bars 25 toward the columnar body 6 from lock pieces 35 which will be described later. FIG. 4 shows the transmit bars 25 whose tip ends are drawn toward the columnar body 6 in a state in which the force pressed by the transmit bars 25 is released.

Figure 5:
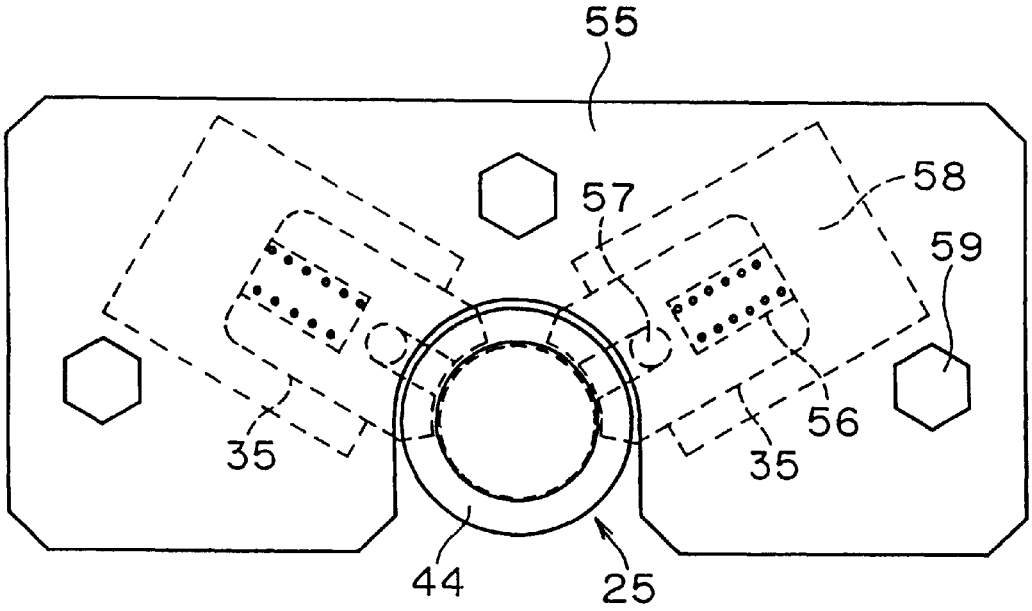
FIG. 5 is a front view of a state in which a lock piece engages the transmit bar.
Figure 6:
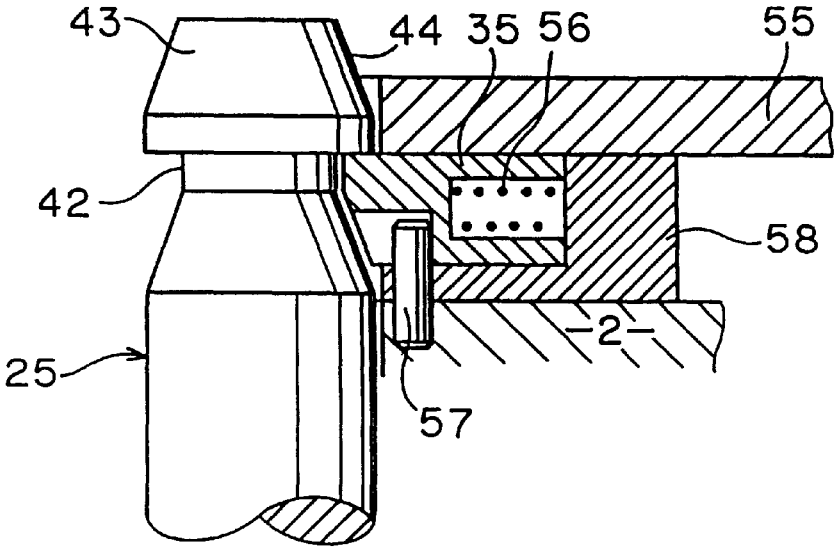
FIG. 6 is a partial cross-sectional view of a state in which a lock piece engages the transmit bar.

As shown in FIG. 5, two lock pieces 35 are disposed at positions opposed to the tip ends of the transmit bars 25 of the lower die 1. An annular groove 42 is formed in the tip end of each of the transmit bars 25 to form a head portion 43. The head portion 43 is formed at its outer periphery with a tapered surface 44. When a pressing force of gas springs 45 which will be described later is released and rods 46 thereof are retracted, and if the transmit bars 25 enter toward the lock pieces 35 and the tapered surface 44 passes through the lock pieces 35, the lock pieces 35 engage the annular grooves 42 as shown in FIG. 6 and then, the transmit bars 25 cannot retreat toward the columnar body 6, and the transmit bars 25 are brought into locked states.

Each of the lock pieces 35 is covered with a cover 58 and is slidably provided on a base 55 toward the transmit bar 25, and is biased toward the transmit bar 25 by a compressed coil spring 56. The movement of the lock piece 35 toward the transmit bar 25 is restricted by a stopping pin 57 rising from the lower die 2. The base 55 is fixed to the lower die by bolts 59. The lock means is not limited to the above-described structure, but may comprise other embodiment for performing the same function.

Each of the gas springs 45 is located at a position opposed to the transmit bar 25 such that the gas spring 45 can advance and retract in the axial direction of the transmit bar 25. The gas spring 45 is fixed to a moving base 47, and the moving base 47 is moved on a rail 49 fixed to the lower die 1. A follower cam 50 is fixed to the moving base 47. An operating member 51 is mounted to the upper die 4 opposed to this follower cam 50 through a bolt 67. The operating member 51 is rotatably provided with a roller 52, and the roller 52 is set such that it can abut against the follower cam 50.

High pressure gas suitable for use, e.g., high pressure gas of 150 kg/cm$^2$, is accommodated in a cylinder 54 of the gas spring 45. Therefore, even if the rod 46 projecting from the cylinder 54 extends or retracts, substantially constant output, e.g., output of 150 kg/cm$^2$, can be obtained over the entire length of the retracting stroke of the rod. That is, two tanks are built in the cylinder 54, and if the rod 46 retracts and pressure is applied to one of the tanks, high pressure gas flows out from the one tank and flows into the other tank so that substantially constant output can be obtained over the entire stroke of the rod 46.

As described above, the gas spring 45 is different from the coil spring, and when the gas spring 45 starts operating, high output can be obtained over the entire stroke, and it is possible to reliably transmit the pressure to the pad 22 through the transmit bar 25.

The description has been made of the gas spring as an example of the pressure apparatus. However, the pressure apparatus should not be limited to the gas spring in the present invention, but may comprise other arrangements for performing the same function as a resilient member or the gas spring. The transmit means of the pressure apparatus also should not be limited to the above example.

If a stroke of the moving base 47 is represented by S2, a stroke of the rod 46 of the gas spring 45 is also equal to S2. The stroke S2 of the gas spring 45 is set to a stroke capable of sufficiently pressing the pad 22. Since the coil spring 34 may only draw the transmit bar 25 toward the workpiece W, its stroke S1 is generally set smaller than S2.

A stopper limits movement of the pad 22 which is pushed by the rod 46 of the gas spring 45 through the transmit bar 25. The stopper 53 is fixed to the columnar body 6 by a bolt 60.

The pressing stroke of the moving base 47 is carried out by abutment of the roller 52 of the operating member 51 against the follower cam 50 as the upper die 4 is lowered. If the upper die 4 rises, the operating member 51 which has restricted the moving base 47 rises so that the moving base 47 is not restricted by the operating member 51, and the moving base 47 is returned by the reaction force of the gas spring 45. In order to reliably return the moving base 47, the moving base 47 is biased toward the operating member 51 by a spring (not shown) in addition to the reaction force of the gas spring 45.

The operation of the negative angular forming dies will be described below. First, the upper die 4 is located at its top dead center, and at that time, the workpiece W is placed on the supporting portion 2 of the lower die 1. At that time, the columnar 6 body is located at the forming position in a state in which the piston rod 62 of the air cylinder 61 is extended.

Next, the upper die 4 starts lowering, the pad 13 first pushes the workpiece W against the supporting portion 2 and then, as shown in FIG. 2, the lower surface of the slide cam 9 abuts against a rotating plate 90 which is fixed to the columnar body 6 through the bolt 64 such that the slide cam 9 does not interfere with the entering forming portion 5 of the columnar body 6. At that time, the roller 52 of the operating member 51 of the upper die 4 abuts against the follower cam 50 of the moving base 47, and the moving base 47 starts advancing.

Figure 7:
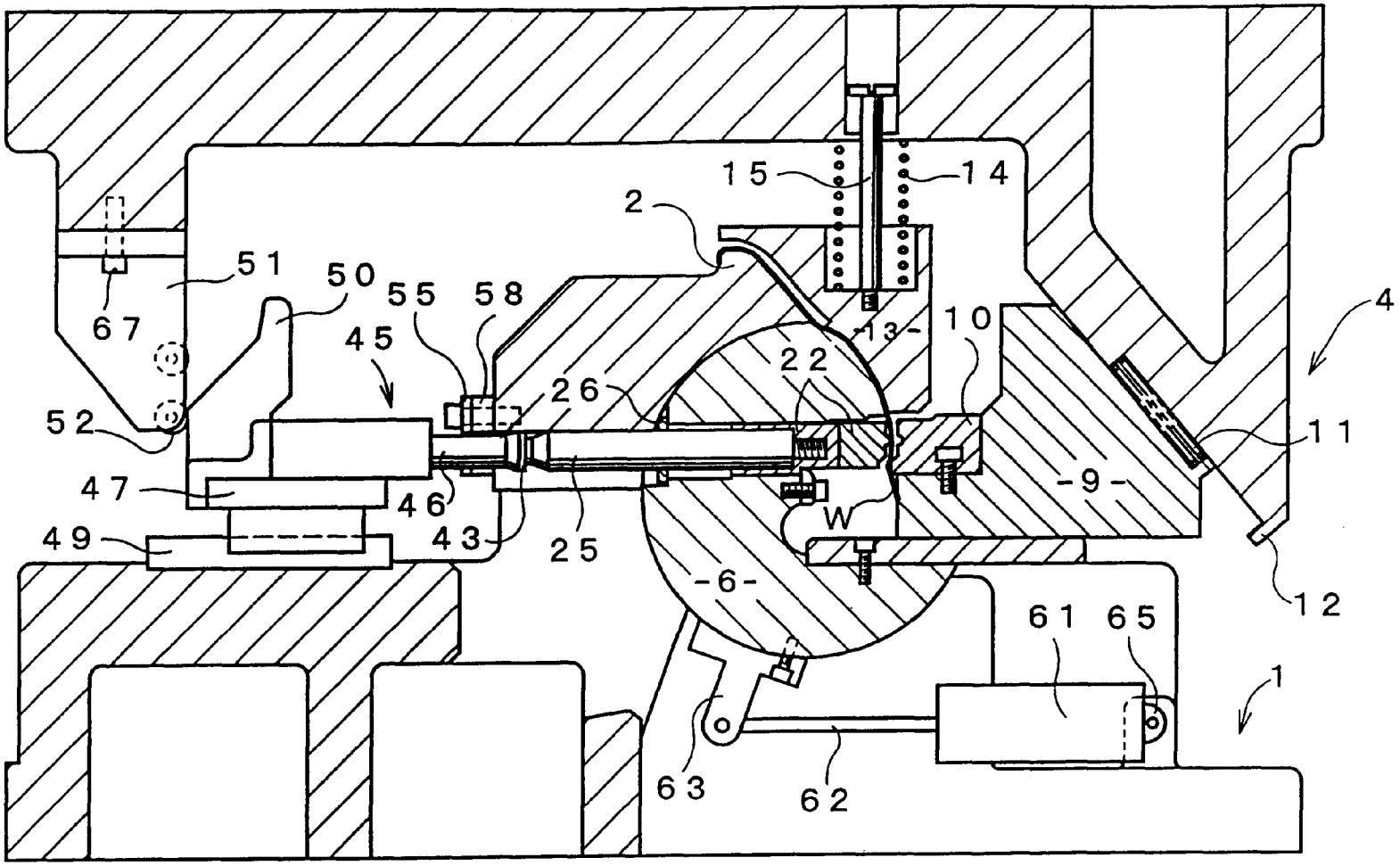
FIG. 7 is a vertical cross-sectional view of a state in which the upper die of the negative angular forming dies of the present invention is lowered and abutted against the lower die.

As shown in FIG. 7, the pad 22 starts contacting with the workpiece W.

The moving base 47 and the gas springs 45 advance toward the workpiece W, and the rods 46 push the transmit bars 25. The slide cam 9 also advances toward the workpiece W, and the entering forming portion 10 and the pad 22 press and clamp the workpiece W.

Figure 8:
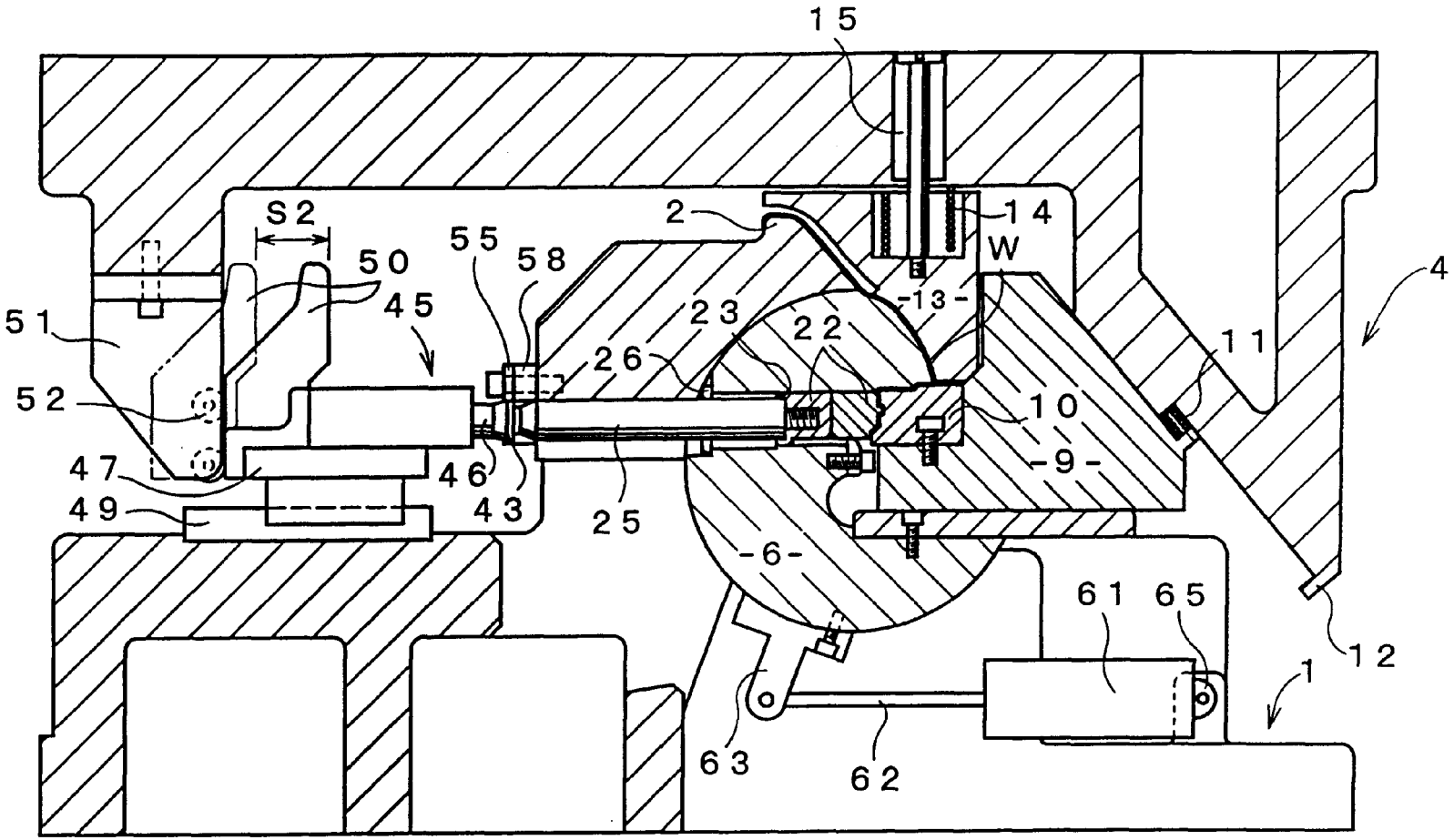
FIG. 8 is a vertical cross-sectional view of a state in which the upper die of the negative angular forming dies of the present invention is at its bottom dead center.

Next, when the upper die 4 is lowered, as shown in FIG. 8, the entering forming portion 10 of the slide cam 9 moves toward the gas springs 25. The transmit bars 25 are also moved toward the gas spring 45, and the workpiece W reaches the bottom dead center while being pressed.

At that time, the head portion 43 of the rod 25 passes through the holding pieces 35 against the biasing force of the coil spring 56 as shown in FIG. 5, and the holding pieces 35 engage the annular groove 42 as shown in FIG. 6 and then, the transmit bars 25 cannot retract toward the columnar body 6 and are locked in place.

Figure 9:
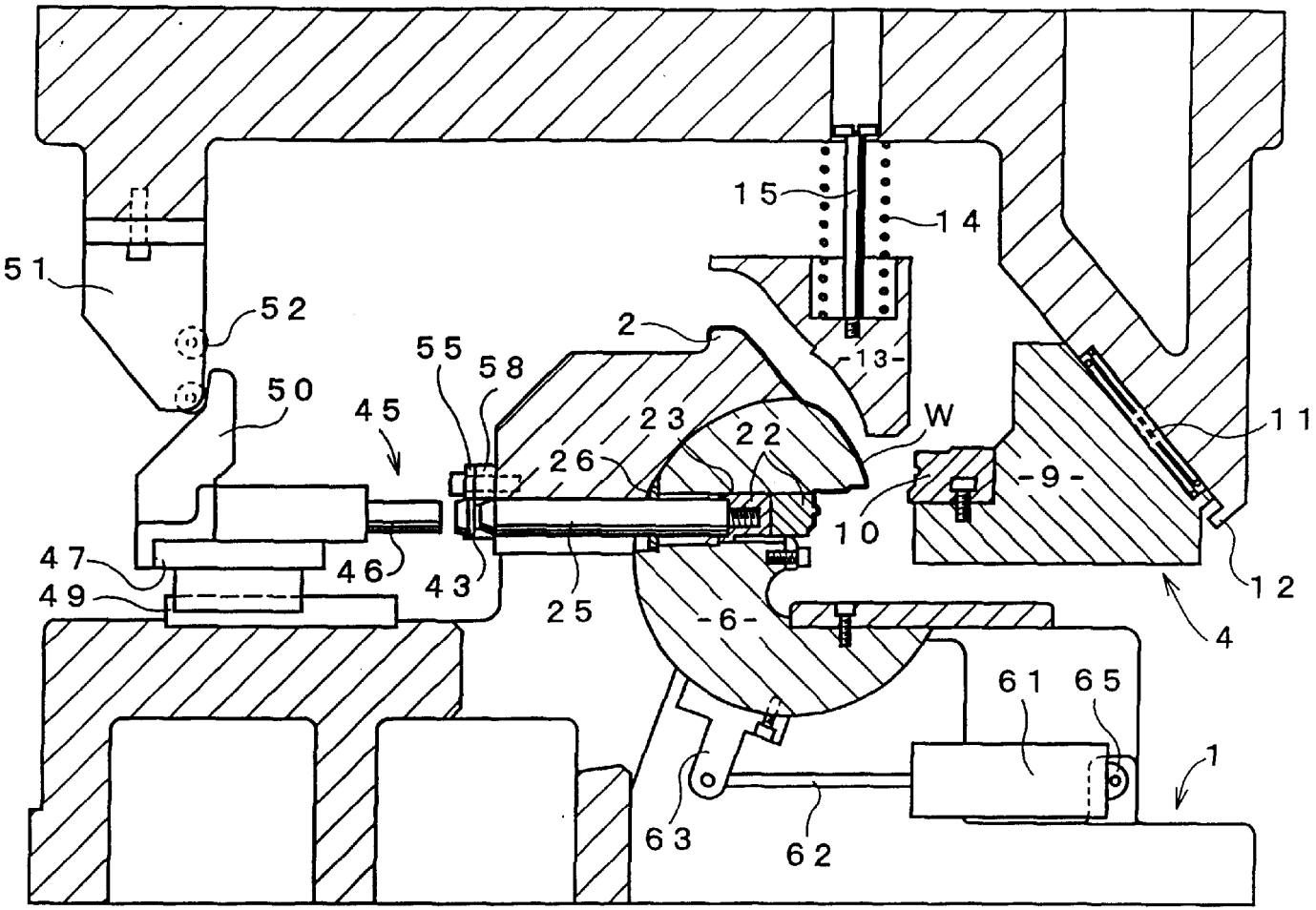
FIG. 9 is a vertical cross-sectional view of a state in which the negative angular forming dies of the present invention carries out the entering forming and the upper die rises.

After the entering forming process, the upper die 4 starts rising. As shown in FIG. 9, the slide cam 9 is biased outward of the dies by the coil spring 11, and the slide cam 9 moves rightward.

The slide cam 9, which has been restricted by the columnar body 6, rises.

When the upper die 4 rises, the restriction of the moving base 47 by the operating member 51 is released, and the moving base 47 is retracted by the reaction force of the gas spring 45. At that time, if the transmit bars 25 were not locked, the transmit bars 25 would move toward the workpiece W by the rods 46 of the gas springs 45, and the formed workpiece W would be deformed. The transmit bars 25 are locked so that the workpiece W is not deformed. The lock means plays an important role in preventing deformation of the formed workpiece W.

Figure 10:
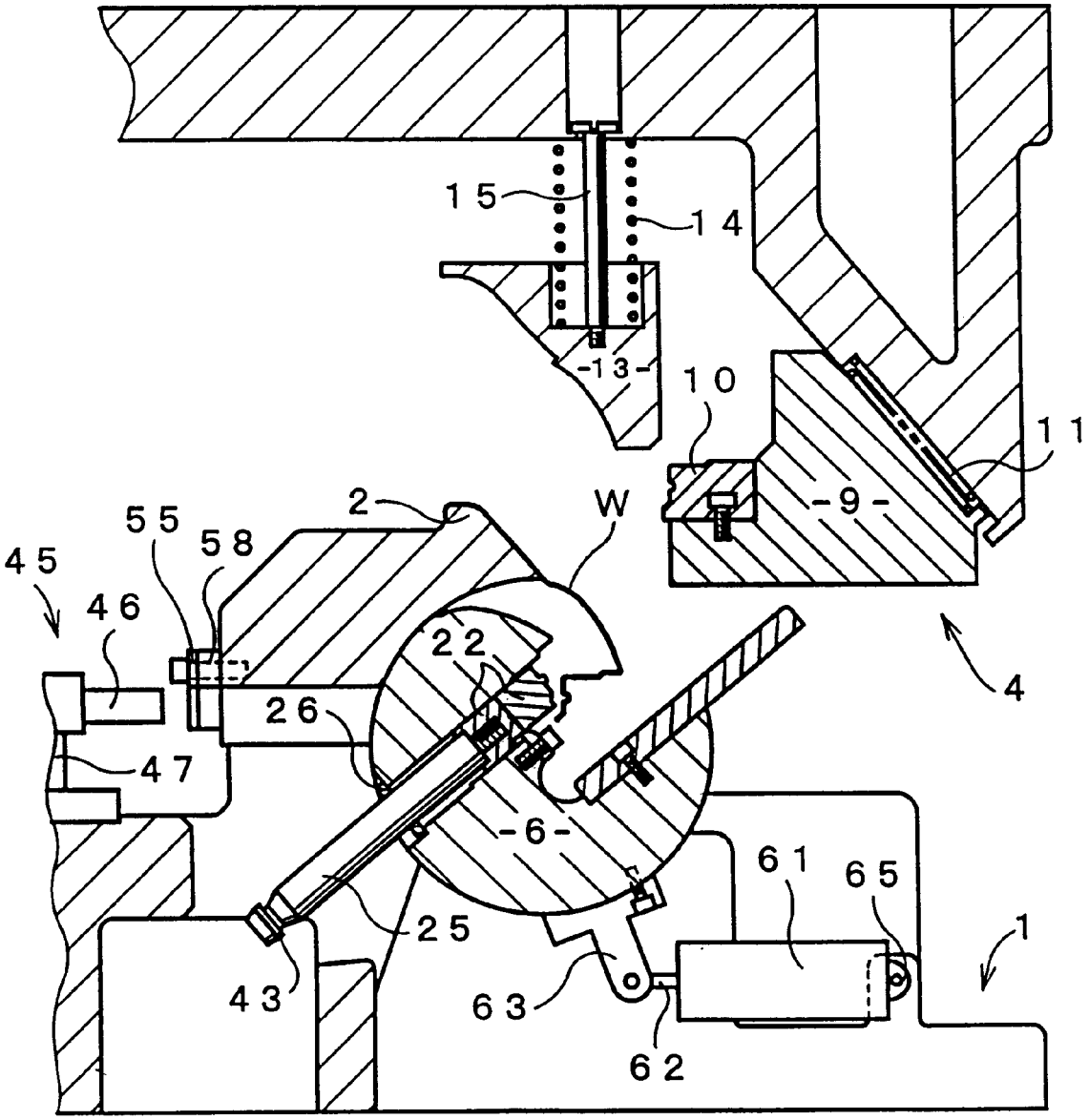
FIG. 10 is a vertical cross-sectional view of a state in which the negative angular forming dies of the present invention carries out the entering forming, the upper die rises, and the columnar body is rotated and retracted.
Figure 11:
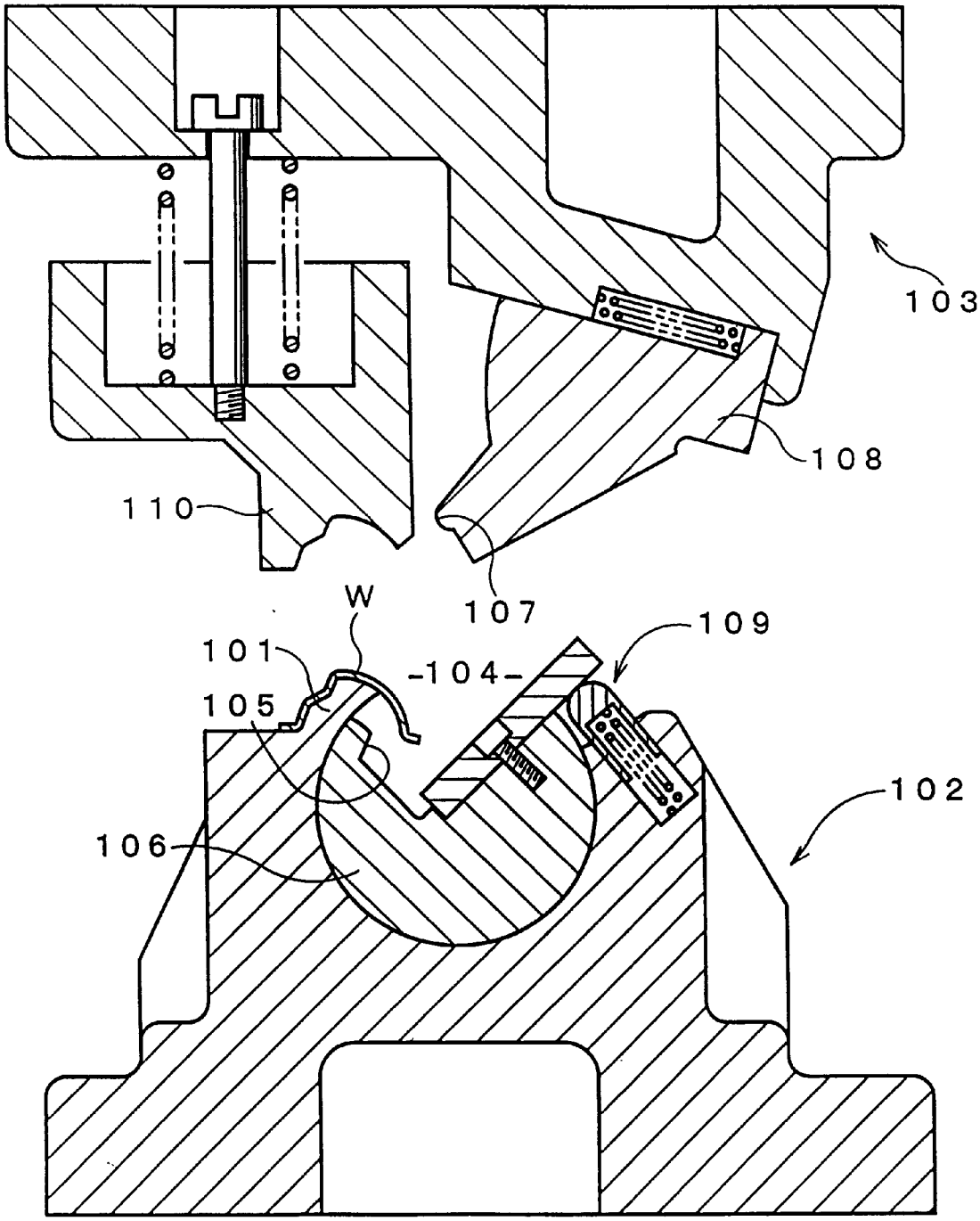
FIG.11 Background Art
FIG. 11 is a vertical cross-sectional view of a state in which an upper die of conventional angular forming dies for entering forming is at its top dead center.
Figure 12:
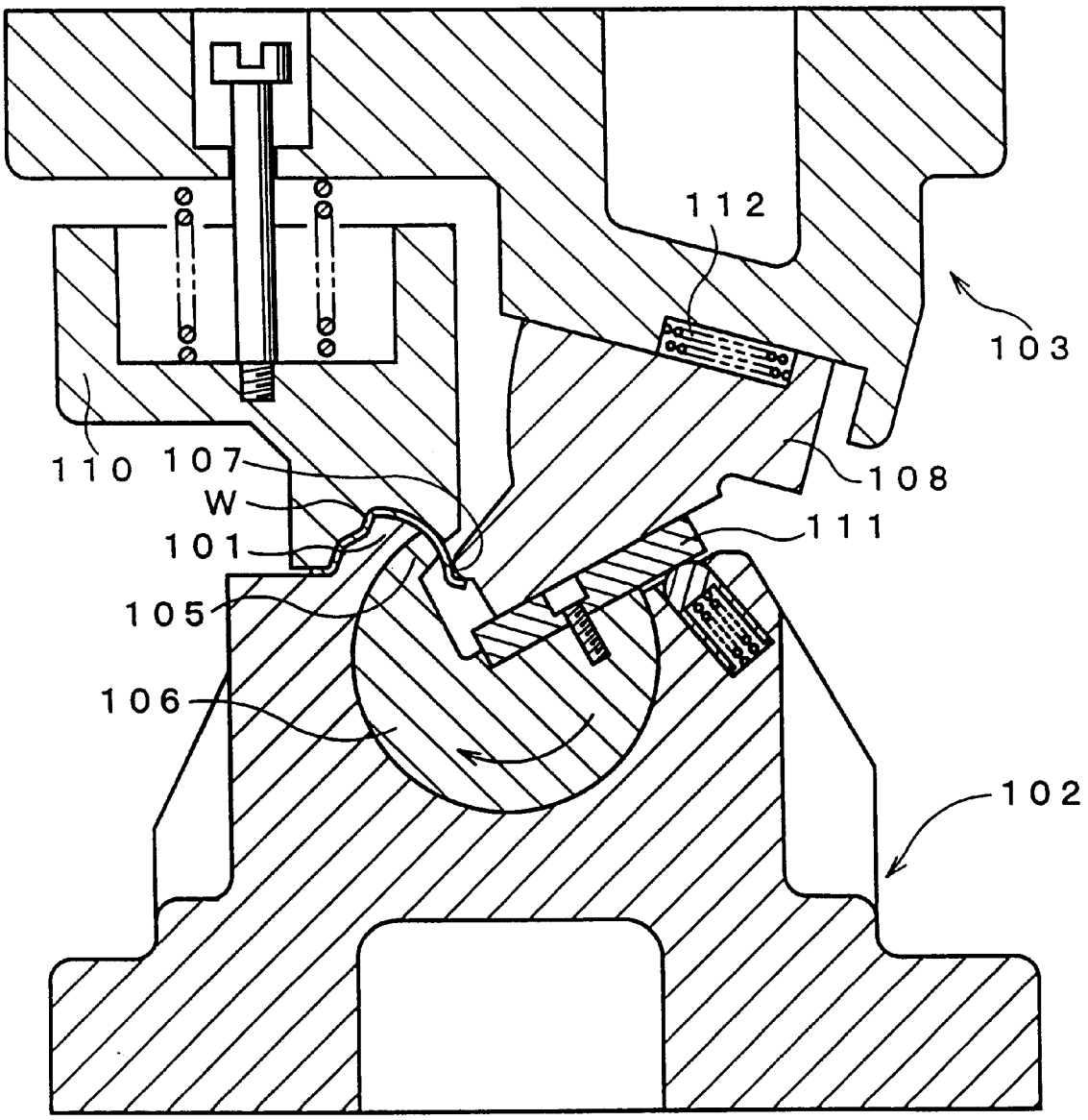
FIG.12 Background Art
FIG. 12 is a vertical cross-sectional view of a state in which the upper die of the conventional negative angular forming dies shown in FIG. 11 is lowered and a slide cam which abuts against a lower die starts contacting with a workpiece.
Figure 13:
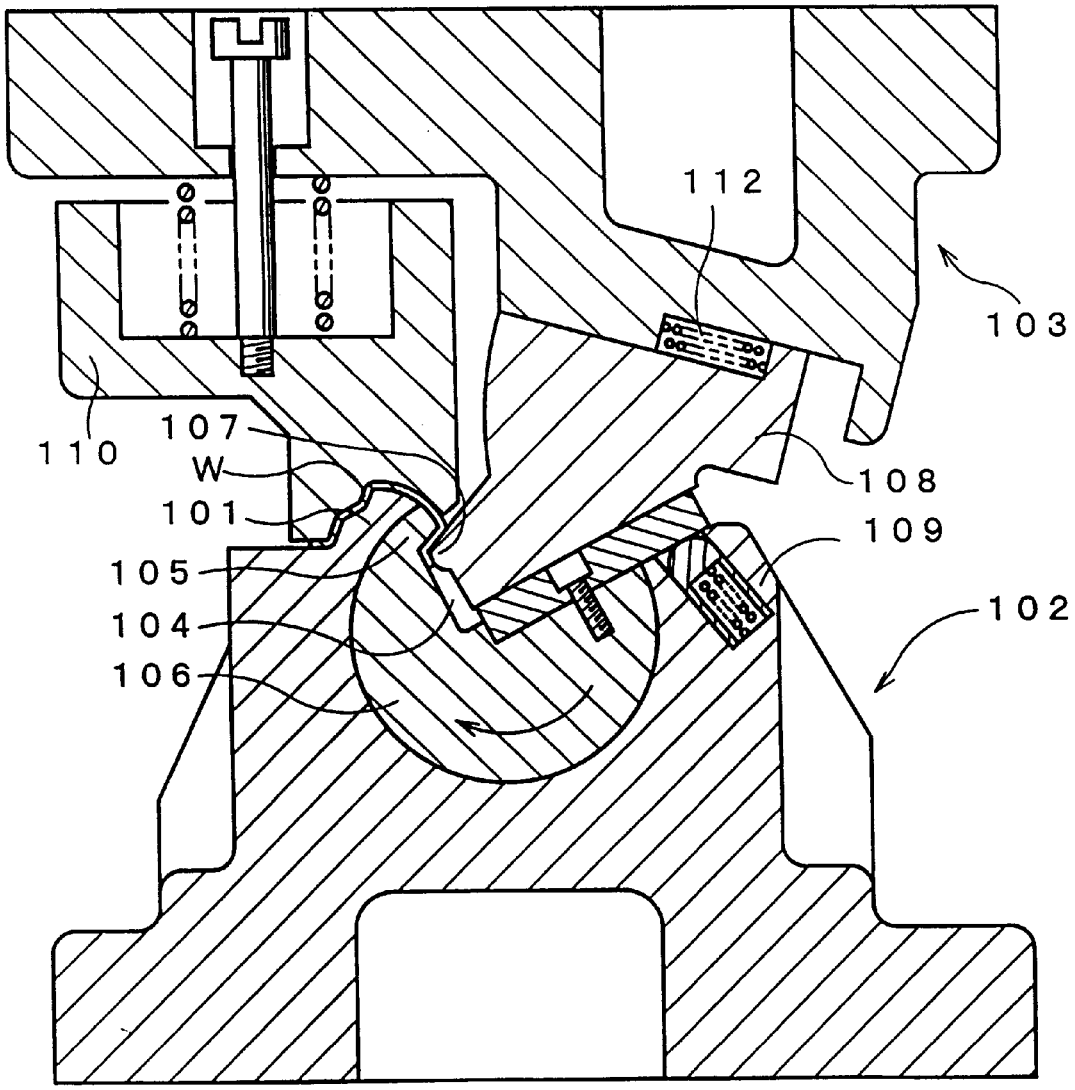
FIG.13 Background Art
FIG. 13 is a vertical cross-sectional view of a state in which the upper die of the conventional negative angular forming dies shown in FIG. 11 is at its bottom dead center.
Figure 14:
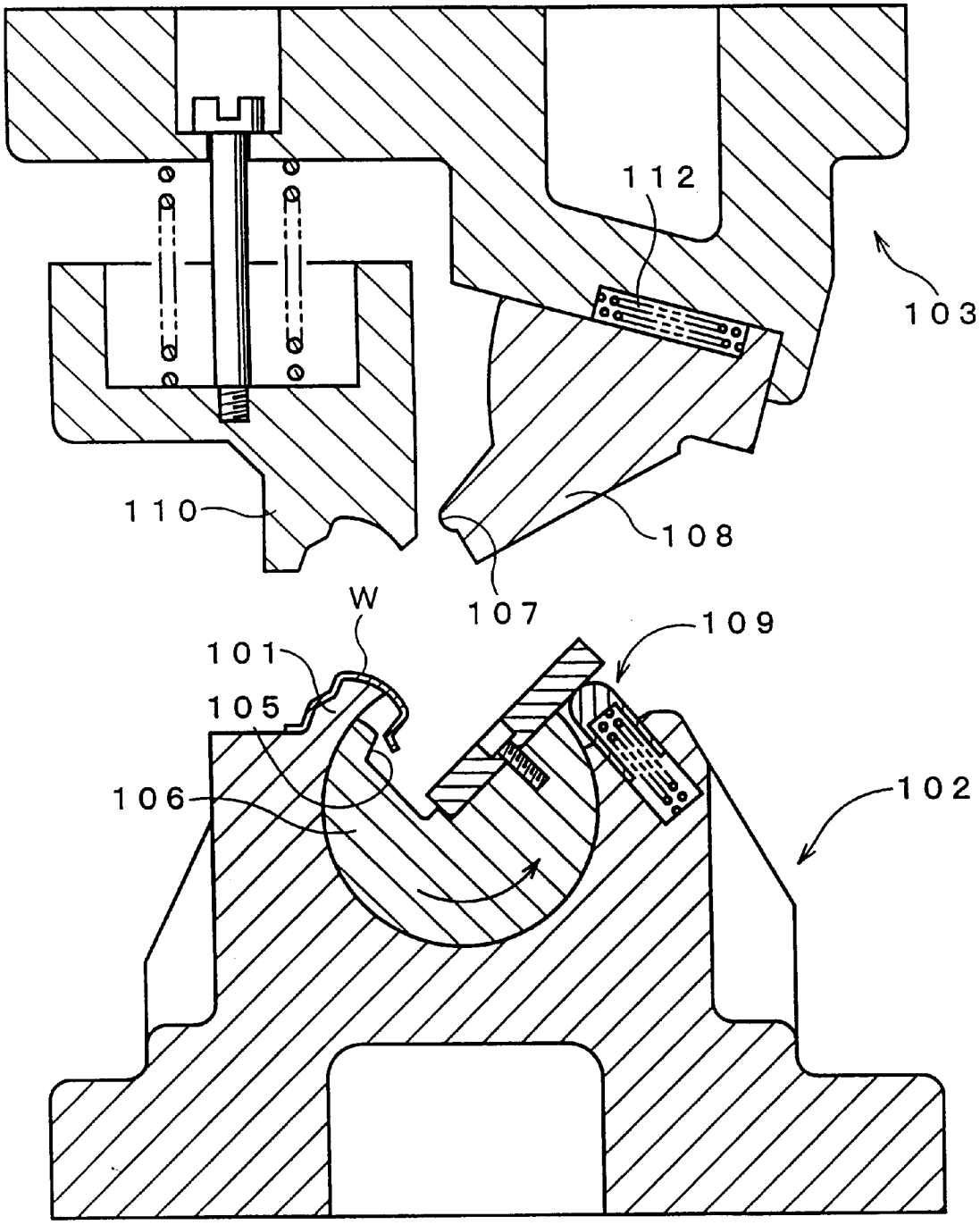
FIG.14 Background Art
FIG. 14 is a vertical cross-sectional view of a state in which the conventional negative angular forming dies shown in FIG. 11 carries out the entering forming, and the upper die rises to the top dead center position.

The piston rod 62 of the air cylinder 61 is retracted to turn the columnar body 6 counter-clockwise as shown in FIG. 10 so that when the formed workpiece W may be taken out from the lower die 1. The workpiece W can be taken out without interfering with the entering forming portion of the columnar body 6. When the columnar body 6 is turned counter-clockwise by the air cylinder 61, the engagement between the transmit bars 25 and the holding pieces 25 is released (in FIG. 5, the holding pieces 35 are not disposed below and the transmit bars 25 are allowed to turn downward). The pad 22 biased by the coil spring 34 is moved rightward as viewed in the drawing, the workpiece W is floated up, and the head portion 43 of the transmit bar 25 is drawn toward the columnar body 6.

Next, if the columnar body 6 is turned clockwise as viewed in the Figures to a state by extending the air cylinder 61, the transmit bars 25 are also turned together with the columnar body 6, and the head portion 43 of the transmit bars 25 are located closer to the columnar body 6, and the head portion 43 of the transmit bars 25 are located closer to the columnar body 6 than the holding pieces 35. This state is the state where the workpiece W has not yet been placed in the lower die 1.

As described above, in the negative angular forming dies of the present invention in which a lowering locus of the upper die enters into the lower die, a wrinkle is prevented from being generated in the entering portion of a workpiece by pressing and clamping the entering portion of the work.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A negative angular forming die comprising:

a lower die having a supporting portion for supporting a workpiece;

a columnar body rotatably supported on said lower die, the columnar body having a groove therein for receiving a portion of said workpiece therein during working of said workpiece;

an upper die which is lowerable with respect to said lower die;

a slide cam provided on the upper die and opposed to the columnar body;

a forming portion provided on the slide cam, the forming portion being engageable with the workpiece when the upper die is lowered;

a returning tool provided on the lower die for rotating the columnar body to a position at which the workpiece can be removed from the lower die; and a clamping member, the clamping member being engageable with a side of the workpiece which is opposite to a side of the workpiece which is engageable with the forming portion of the slide cam.

2. The forming die of claim 1, wherein the clamping member is slidably mounted on the columnar body, an end of the clamping member being translatable in the groove of the columnar body.

3. The forming die of claim 2, wherein:

when the upper die is lowered, the slide cam engages a surface of the lower die and moves generally perpendicularly to the lowering direction; and the generally perpendicular motion of the slide cam advances the forming portion into the groove of the columnar body, so that the workpiece is deformed between the clamping member and the forming portion of the slide cam.

4. The forming die of claim 2, further comprising:

a biasing member, the biasing member being capable of exerting a force on the clamping member via a transmit member when the upper die is lowered.

5. The forming die of claim 4, further comprising:

a follower cam operatively connected to the biasing member;

an operating member connected to the upper die; and a moving base, the biasing member being mounted on the moving base; wherein when the upper die is lowered, the operating member engages the follower cam, which advances the biasing member in a direction generally perpendicular to the lowering direction of the upper die, the generally perpendicular motion of the biasing member advancing the clamping member towards the workpiece.

6. The forming die of claim 4, further comprising:

a lock piece, the lock piece engaging a portion of the transmit member to oppose the force exerted by the biasing member on the transmit member, the lock piece engaging the transmit member when the forming portion of the slide cam has at least substantially completed forming of the workpiece.

7. The forming die of claim 4, wherein:

the transmit member includes a plurality of transmit bars;

the clamping member includes at least one pad, the at least one pad being opposed to a surface of the columnar body, and, being engageable with an end of each of the plurality of transmit members; and the columnar body includes a resilient member, the resilient member biasing the pads away from said surface of the columnar body.

8. The forming die of claim 1, further comprising:

a pad supported on the upper die, the pad being engageable with the workpiece such that a portion of the workpiece is supported between the pad and the columnar body during forming of the workpiece.

9. The forming die of claim 1, wherein the return tool includes:

a biasing element, the biasing element being supported on the lower die; and a link, the biasing element exerting a force on the columnar body via the link.

10. The forming die of claim 9, wherein the biasing element includes a gas spring, the gas spring having a piston rod pivotably connected to the link, and, wherein the link is pivotably mounted to the columnar body.

11. The forming die of claim 1, further comprising:

a plate supported on the columnar body; wherein the slide cam is engageable with the plate when the upper die is lowered, the slide cam advancing along a surface the plate in a direction which is generally perpendicular to the lowering direction.

12. A pressing apparatus comprising:

a lower die having a supporting portion for supporting a workpiece;

a columnar body rotatably supported on said lower die, the columnar body having a groove therein for receiving a portion of said workpiece therein during working of said workpiece;

an upper die which is lowerable with respect to said lower die;

a slide cam provided on the upper die and opposed to the columnar body;

a first forming portion provided on the slide cam, the first forming portion being engageable with the workpiece when the upper die is lowered;

a returning tool provided on the lower die for rotating the columnar body to a position at which the workpiece can be removed from the lower die; and a workpiece pressing and clamping member for pressing and clamping the workpiece, the workpiece pressing and clamping member including:

a second forming portion slidably mounted on the columnar body;

a transmit member operatively connected to the second forming portion for transmitting a force;

a biasing member for transmitting said force to the transmit member;

a moving base for supporting said biasing member as said upper die is lowered; and lock means for locking the movement of the transmit member.

13. The pressing apparatus of claim 12, wherein:

the transmit member includes at least one bar having a groove;

the biasing member includes a gas spring;

the lock means includes a holding piece which is engageable with the groove of the transmit member; and a resilient element is interposed between the second forming portion of the workpiece pressing and clamping member and the columnar body, the resilient element biasing the second forming portion and the transmit member towards the workpiece.

14. A forming die comprising:

a lower die having a supporting portion for supporting a workpiece;

a columnar body rotatable supported on said lower die, the columnar body having a groove therein for receiving a portion of said workpiece therein during working of said workpiece;

an upper die which is lowerable with respect to said lower die;

a forming portion supported on the upper die which is engageable with the workpiece; and a clamping member, the clamping member being engageable with a side of the workpiece which is opposite to a side of the workpiece which is engageable with the forming portion, wherein the clamping member is slidably mounted within the columnar body.

15. The forming die of claim 14, wherein the clamping member includes a forming portion, the forming portion of the clamping member being engageable with a side of the workpiece which is opposite to the side of the workpiece engageable with the forming piece supported on the upper die, such that when the upper die is lowered, the workpiece is deformed between the two forming portions.

* * * * *